United States Patent [19]

Hemperly

[11] 3,969,160

[45] July 13, 1976

[54] HIGH-STRENGTH DUCTILE URANIUM ALLOY

[75] Inventor: Vernon C. Hemperly, Oak Ridge, Tenn.

[73] Assignee: The United States of America as represented by the United States Energy Research and Development Administration, Washington, D.C.

[22] Filed: June 3, 1975

[21] Appl. No.: 583,368

[52] U.S. Cl. ..... 148/32.5; 75/122.7; 148/132

[51] Int. Cl.[2] ..... C22C 28/00

[58] Field of Search ..... 148/32.5, 132; 75/122.7

[56] References Cited

UNITED STATES PATENTS

| | | | |
|---|---|---|---|
| 2,990,274 | 6/1961 | Greenberg | 75/122.7 |
| 3,109,730 | 11/1963 | Zegler | 75/122.7 |
| 3,177,069 | 4/1965 | Englander et al. | 75/122.7 |

FOREIGN PATENTS OR APPLICATIONS

| | | | |
|---|---|---|---|
| 823,392 | 11/1959 | United Kingdom | 75/122.7 |

OTHER PUBLICATIONS

"Some Properties of Uranium–Low Titanium Alloys," Murphy, Trans. ASM, vol. 50, pp. 40–1 to 40–25; 12/57.

*Primary Examiner*—Arthur J. Steiner
*Attorney, Agent, or Firm*—Dean E. Carlson; David S. Zachry; John B. Hardaway

[57] ABSTRACT

A novel alloy composition consisting essentially of 0.7 to 0.8 weight percent titanium and 0.2 to 0.3 weight percent vanadium with the balance being uranium.

3 Claims, 2 Drawing Figures

HIGH-STRENGTH DUCTILE URANIUM ALLOY

BACKGROUND OF THE INVENTION

This invention was made in the course of, or under, a contract with the Energy Research and Development Administration. It relates generally to the art of uranium alloys and more particularly to uranium alloys with desirable mechanical properties.

In the prior art, uranium alloys with small titanium additions have been used where improved corrosion resistance was required. Such an alloy is disclosed in U.S. Pat. No. 2,743,174 wherein uranium alloys containing 1 to 15 weight percent titanium are disclosed. Low level alloys containing less than one percent titanium have also been used for their useful mechanical properties after solution treating and age hardening. However, such titanium alloys suffer from the disadvantage of having poor forming and ductility properties.

One known cause of the poor ductility properties is large inclusions of titanium carbide which are formed from carbon impurities within the uranium. One prior art technique for partially alleviating this problem comprises the use of long melt times and/or double melts during which the carbide floats to the top as a titanium carbide slag. The titanium carbide is thus separated from the system as a slag. However, the problem is not totally solved by such technique because some titanium carbide precipitates always appear in the system to act as stress risers and vacancy sinks.

SUMMARY OF THE INVENTION

It is thus an object of this invention to provide a novel uranium alloy having the anti-corrosion advantages of titanium alloys but with improved ductility characteristics.

This object, as well as other objects, is accomplished by a uranium-titanium alloy having sufficient vanadium alloying additions to effectively inhibit the growth of titanium carbide inclusions.

DETAILED DESCRIPTION

Figure 1:
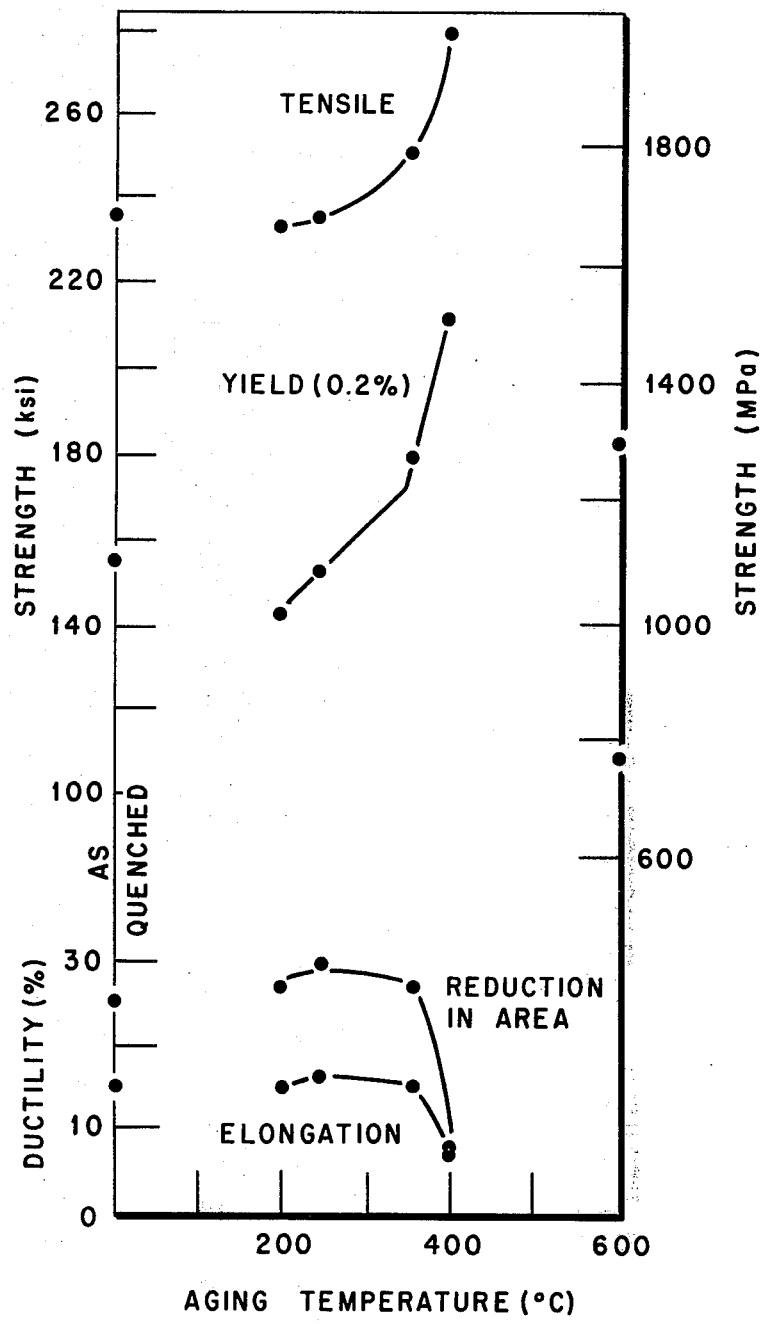
FIGS. 1 and 2 graphically illustrate the mechanical properties of alloys produced in accordance with Examples I and II.

According to this invention, it has been found that small alloying additions of vanadium to conventional uranium-titanium alloys produce a resulting alloy with greatly improved mechanical properties. As used within this disclosure, a conventional uranium-titanium alloy is one which contains 0.7 to 0.8 weight percent titanium. The vanadium additions in accordance with this invention produce an alloy having finer grain structure, greater ductility, as well as greater yield and ultimate strength than the base uranium-titanium alloy when both are solution treated and age hardened. The resulting alloy of this invention has the above enhanced properties without deleteriously affecting the execellent anti-corrosion properties of the base uranium-titanium system. The morphology at room temperature is alpha-prime uranium with both the titanium and vanadium in solution and some alpha uranium growing from the grain boundaries. At the solution treating temperature the alloy is gamma uranium with both alloying additions in solution.

The alloys thus contemplated to be within the scope of this invention are those conventional uranium-titanium alloys with sufficient vanadium additions to cause a reduction in the size of titanium carbide inclusions. Such an alloy has a vanadium content which lies within the range of 0.1 to 0.5 weight percent. It has been found that the desirable ductility characteristics are not produced at either of these extremes. However, an effective and preferred composition range is within limits of 0.2 to 0.3 weight percent vanadium. An optimum composition contains 0.25 weight percent vanadium and 0.75 weight percent titanium. This composition possesses greatly improved ductility properties.

While the foregoing description of the alloy of this invention has placed primary emphasis upon the composition, those of skill in the art will be aware that thermal and fabrication histories of the alloy play a major roll in the resulting properties. The alloy of this invention is preferably prepared by a double melt procedure. In the molten state, the titanium alloys contain titanium carbide as well as titanium in solution. Increasing melt temperature and time permits separation of the carbide, and double melting, as used herein, is one technique to accomplish this. Titanium carbide inclusions remaining in the alloy act as stress risers and reduce ductility. The vanadium addition in accordance with this invention reduces the titanium carbide inclusion size by some unknown mechanism.

The desirable mechanical properties are obtained by the conventional heat treating procedures of solution treating, water quenching, and aging. As with conventional age hardening processes, the mechanical properties developed vary with the thickness of the material.

As is now apparent, this invention is principally concerned with uranium alloys possessing the desirable mechanical, and particularly the ductility, properties discussed above. Reference in this disclosure to the ternary alloy of uranium-titanium-vanadium refers to an alloy possessing such ductility characteristics. Various additives and impurities may be present in the alloy without adversely affecting these properties and such impure alloys are includable within the scope of this invention. Impurities which may be present in small amounts without adversely affecting the mechanical properties of this invention are, in ppm: Mo, 60; Al, 60; Cu, 40; Fe, 200; Mu, 50; Ni, 50; Si, 200; Mg, 5; and Ca, 10. Hydrogen levels of greater than 5 ppm will adversely affect the mechanical properties of the alloy of this invention. Such adverse level of hydrogen can be avoided or its effects appropriately minimized by known techniques, such as melting and solution treating in vacuum.

High carbon levels, as mentioned previously, adversely affect the mechanical properties of the alloy of this invention. High carbon levels also act to remove the titanium and vanadium additions as a carbide slag during melting. The uranium charge should thus preferably contain less than 70 ppm carbon or otherwise compensated to that level.

Having generally set forth the alloy of this invention, the following specific examples are given as a further illustration thereof.

EXAMPLE I

An alloy was prepared from 15.8 Kg of uranium metal, 131 gm of titanium sponge, and 48 gm of vanadium turnings. The elemental metals were arranged in a zirconia-coated graphite crucible for comelting and pouring. Homogeneity in this alloy was obtained by solutioning and the stirring normally obtained from outgassing of the titanium on comelting with uranium. The charge was melted in a vacuum-induction furnace at 1410°C and poured in vacuo. Then the melting and pouring were repeated at 1410°C in the same furnace. The alloy was cast into an ingot weighing 15.2 Kg and having the dimensions of 1.5 by 5.0 by 7.0 inches. This ingot was homogenized at 1000°C in vacuo for 4 hours and rolled in the alpha phase at about 600°C. The rolled plate had a thickness of 0.5 inch. Coupons about 0.5 inch in width and 5 inches in length were taken from the rolled plate. The coupons were solution treated at 800°C for 1 hour, in vacuo, to remove hydrogen, and water quenched. The coupons were then age hardened at selected temperatures for 1 hour. The mechanical properties attained are shown in FIG. 1 as a function of the aging temperature.

EXAMPLE II

Figure 2:
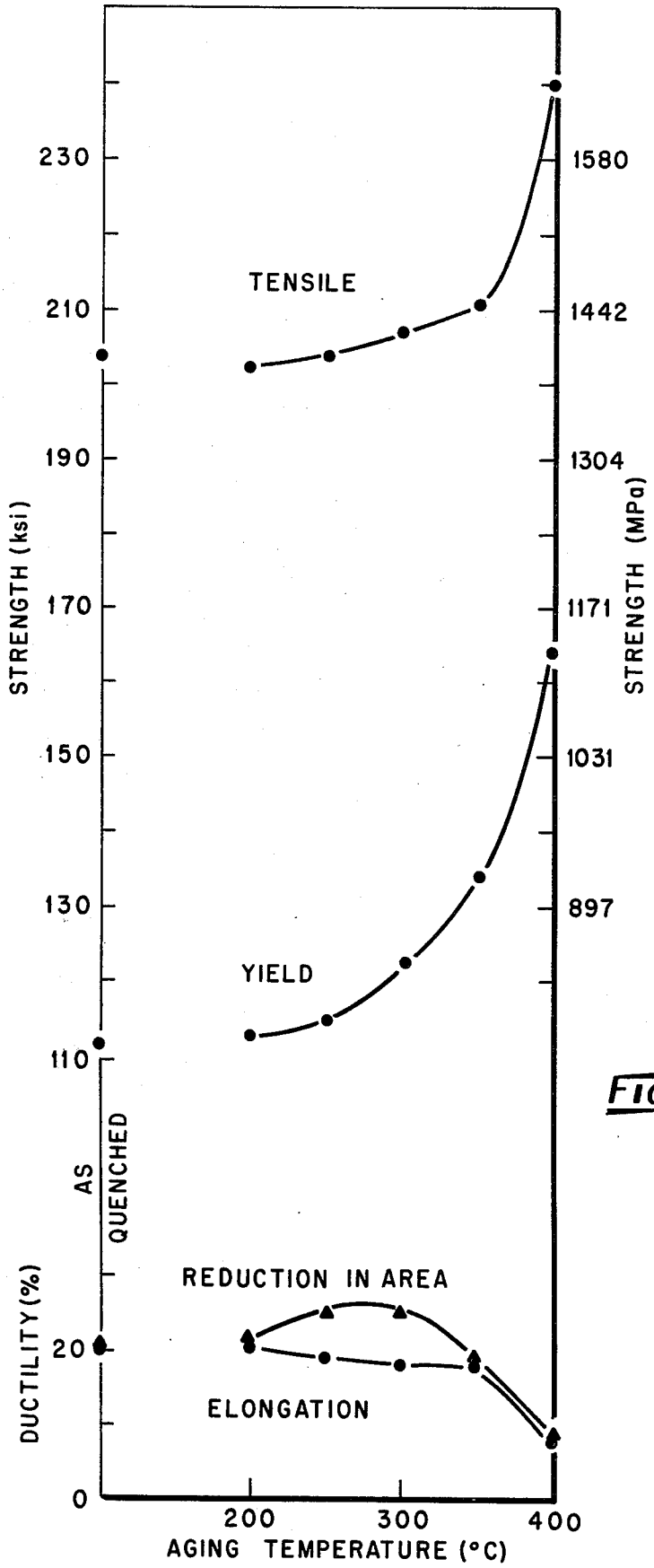

For comparison, an alloy with only 0.1% vanadium addition was prepared in a manner similar to that of Example I. The resulting mechanical properties are illustrated in FIG. 2. The properties of this alloy are similar to those of the conventional uranium-titanium alloys. Such alloys possess neither the strength nor the ductility of an alloy having at least 0.2 weight percent vanadium.

It is thus seen that by the alloy of this invention, conventional uranium-low level titanium alloys have been improved so as to possess desirable ductility properties while retaining the anti-corrosion characteristics. Many variations will be apparent from the above descriptions. Such variations, however, are intended to be embodied within the scope of the appended claims.

What is claimed is:

1. A solution-treated age-hardened uranium alloy having high strength and ductility; consisting essentially of 0.7 to 0.8 weight percent titanium, 0.1 to 0.5 weight percent vanadium in an amount effective to inhibit titanium carbide growth with the balance being uranium.

2. The alloy of claim 1 consisting essentially of 0.2 to 0.3 weight percent vanadium.

3. The alloy of claim 2 consisting essentially of 0.75 weight percent titanium and 0.25 weight percent vanadium.

* * * * *